US010724277B2

(12) United States Patent
Baker et al.

(10) Patent No.: US 10,724,277 B2
(45) Date of Patent: Jul. 28, 2020

(54) REVERSIBLE NON-HANDED LATCH

(71) Applicant: SPECTRUM BRANDS, INC., Middleton, WI (US)

(72) Inventors: Scott C. Baker, Lake Forest, CA (US); John D. Gephart, Mission Viejo, CA (US); Kingsley Su, Xiamen (CN); Alex Wu, Xiamen (CN)

(73) Assignee: Spectrum Brands, Inc., Middleton, WI (US)

( * ) Notice: Subject to any disclaimer, the term of this patent is extended or adjusted under 35 U.S.C. 154(b) by 590 days.

(21) Appl. No.: 15/400,324

(22) Filed: Jan. 6, 2017

(65) Prior Publication Data

US 2017/0198501 A1 Jul. 13, 2017

Related U.S. Application Data

(60) Provisional application No. 62/277,187, filed on Jan. 11, 2016.

(51) Int. Cl.

| | |
|---|---|
| ***E05B 63/04*** | (2006.01) |
| ***E05B 65/00*** | (2006.01) |
| ***E05C 3/04*** | (2006.01) |

(52) U.S. Cl.

CPC ..... *E05B 63/044* (2013.01); *E05B 63/04* (2013.01); *E05B 65/0007* (2013.01); *E05C 3/04* (2013.01); *E05B 63/042* (2013.01)

(58) Field of Classification Search

CPC .... E05B 65/0007; E05B 67/383; E05B 63/04; E05B 17/2038; E05B 2047/0008; E05B 63/0056; E05B 63/0065; Y10T 292/1092; Y10T 292/702; Y10T 292/1097; A01K 1/0017; Y10S 292/29

See application file for complete search history.

(56) References Cited

U.S. PATENT DOCUMENTS

| | | | | |
|---|---|---|---|---|
| 103,586 | A | 5/1870 | Dolan | |
| 891,667 | A | 6/1908 | Browning | |
| 1,136,102 | A | 4/1915 | Clapcott | |
| D68,063 | S | 8/1925 | Ritter | |
| 1,830,786 | A * | 11/1931 | Ferris | E05C 3/14 292/136 |
| 2,644,708 | A * | 7/1953 | Poole | E05C 3/167 292/236 |
| 3,266,831 | A | 8/1966 | Banse | |
| 3,907,344 | A * | 9/1975 | Newlon | E05C 3/167 292/66 |
| D242,322 | S | 11/1976 | Miles | |
| 4,021,063 | A * | 5/1977 | Porter | E05C 1/04 292/67 |
| 5,498,041 | A * | 3/1996 | Bezzerides | E05B 15/022 292/225 |

(Continued)

*Primary Examiner* — Mark A Williams

(74) *Attorney, Agent, or Firm* — Merchant & Gould P.C.

(57) ABSTRACT

A latch assembly with a first mounting plate and a second mounting plate. The assembly includes a first latch holder extending from the first mounting plate. A second latch holder is provided that extends from the second mounting plate. The assembly includes a latch arm including a first portion and a second portion. The latch arm is movable between an unlatched position and a latched position and is selectively reversible to be pivotally connected to either the first latch holder or the second latch holder.

16 Claims, 5 Drawing Sheets

(56) References Cited

U.S. PATENT DOCUMENTS

| | | | | | |
|---|---|---|---|---|---|
| 5,511,835 | A * | 4/1996 | Hardee | E05B 17/2023 | 292/205 |
| 5,782,507 | A * | 7/1998 | Hardee | E05C 1/004 | 292/145 |
| 5,799,990 | A * | 9/1998 | Hardee | E05B 17/2049 | 292/205 |
| D489,243 | S | 5/2004 | Thorp | | |
| 6,808,212 | B1 * | 10/2004 | Hardee | E05B 17/2038 | 292/150 |
| D504,303 | S | 4/2005 | Zambon et al. | | |
| D553,473 | S | 10/2007 | Neri et al. | | |
| D601,403 | S | 10/2009 | Cosby et al. | | |
| D605,493 | S | 12/2009 | Tejszerski | | |
| 7,883,124 | B2 | 2/2011 | Gephart et al. | | |
| 8,308,205 | B2 | 11/2012 | Tejszerski | | |
| D728,346 | S | 5/2015 | James, III | | |
| 2007/0262589 | A1 * | 11/2007 | Moran | A01K 1/0356 | 292/192 |
| 2008/0000163 | A1 * | 1/2008 | Stoffels | E05B 65/0007 | 49/394 |

* cited by examiner

REVERSIBLE NON-HANDED LATCH

RELATED APPLICATIONS

This application claims the benefit of U.S. Provisional Application Ser. No. 62/277,187 filed Jan. 11, 2016, for a "Reversible Non-Handed Latch," which is hereby incorporated by reference in its entirety.

TECHNICAL FIELD

This disclosure is related generally to latches, in particular, this disclosure is related to a reversible latches.

BACKGROUND

Latch assemblies are well known for maintaining swingable members, such as doors and gates, in a closed position. Swingable members are typically hinged on one side to a relatively fixed member, such as a frame or post. Existing latch assemblies are typically "handed," which means the latch needs to be installed in a particular configuration depending on whether the swingable member is hinged on its left or right side. Therefore, the components must be installed in a certain manner, which leads to complexity during installation. Moreover, the latch itself may only be able to open in a single direction, towards the right or left, as dictated by the way the mounting plates are designed to mount to the swinging and fixed members, and the shape of the latch arm.

Therefore, there is a need for a reversible latch assembly that allows the decision to be made as to which direction the swingable member should open at the time of installation.

BRIEF DESCRIPTION OF THE DRAWINGS

The present disclosure will be described hereafter with reference to the attached drawings which are given as non-limiting examples only, in which.

DETAILED DESCRIPTION OF THE DRAWINGS

This disclosure relates generally to a reversible latch assembly. Although the latch assembly is discussed below in conjunction with a gate, the latch could be used with any swingable member, such as doors, cabinets, etc. The latch is reversible and therefore can be installed on either the left or right side of the swingable member. This provides easier and more convenient installation of the latch assembly.

Figure 1:
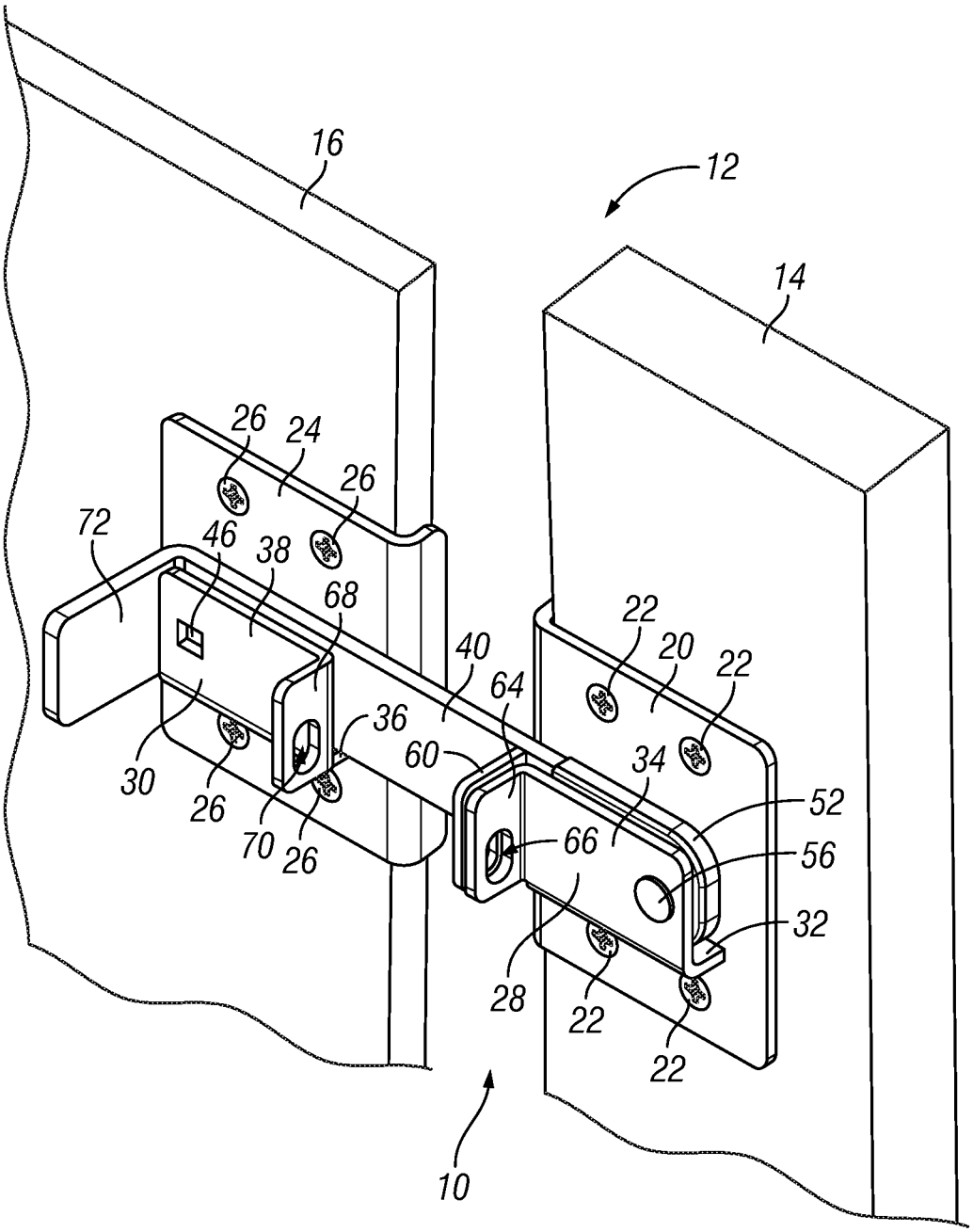
FIG. 1 is a partial perspective view of a gate installed with an example reversible latch assembly according to an embodiment of the disclosure.

FIG. 1 illustratively shows an example latch assembly 10, according to one embodiment, mounted on a gate 12. In this example, the gate 12 includes a gate post 14 and a swingable member 16 that is hinged to another gate post (not shown). As shown, the swingable member 16 is installed in a "left-handed" configuration because it is hinged (not shown) on its left side and the right side of the swingable member 16 is free end to pivot about the hinge. However, as explained below, the latch assembly 10 could be reversed to be installed in a "right-handed" configuration.

Figure 2:
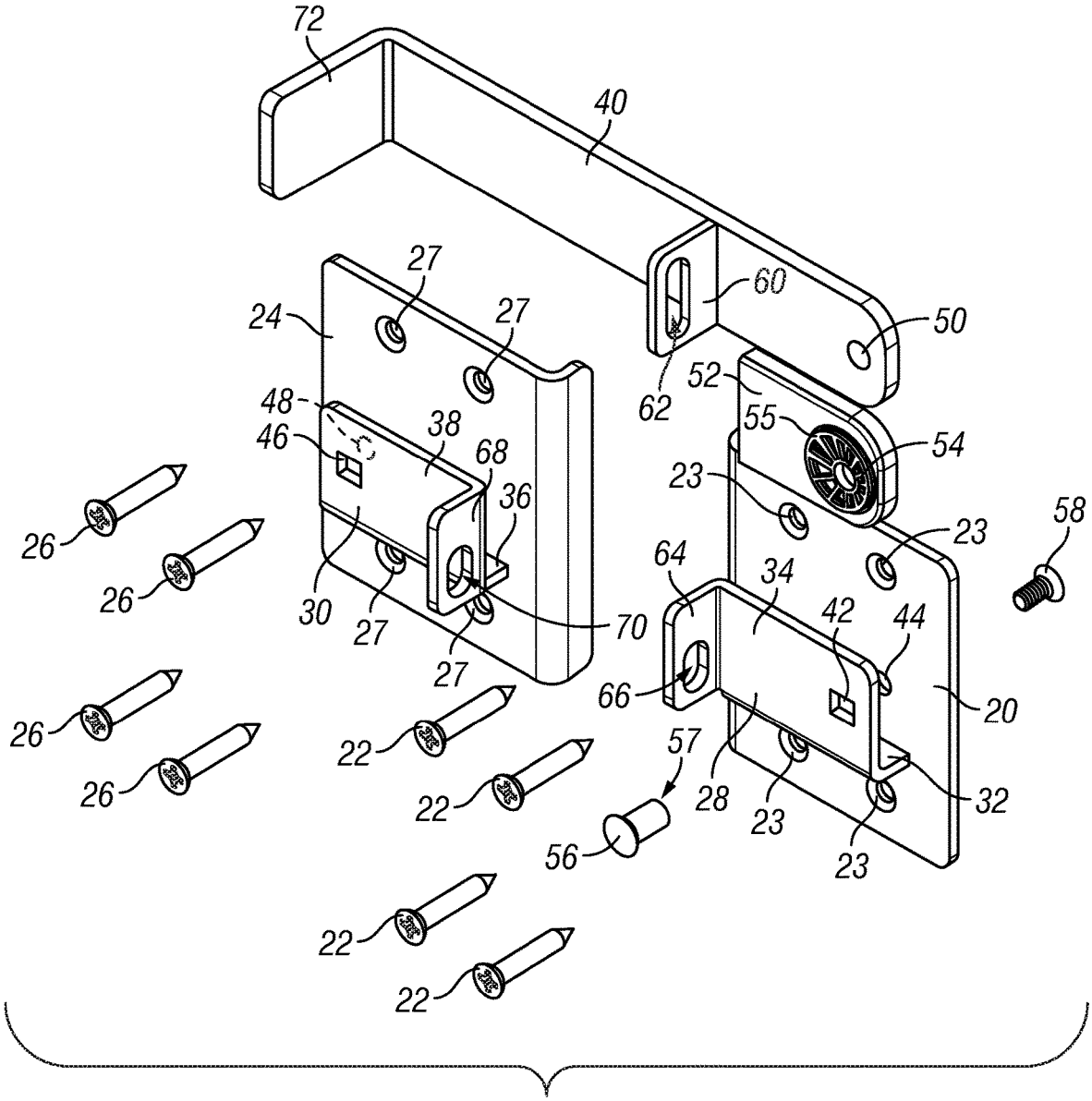
FIG. 2 is an exploded view of the example reversible latch assembly of FIG. 1.

Referring to FIGS. 1 and 2, the latch assembly 10 includes a first mounting plate 20 attached using fasteners 22, which extend through holes 23 in first mounting plate 20, to the gate post 14 and a second mounting plate 24 attached using fasteners 26, which extend through holes 27 in the second mounting plate 24, to the swingable member 16. In the embodiment shown, the latch assembly 10 includes a first latch holder 28 and a second latch holder 30 extending from the first mounting plate 20 and the second mounting plate 24, respectively. The latch holders 28, 30 could be attached to the mounting plates 20, 24 or be unitary therewith. As shown, the first latch holder 28 includes a first wall 32 extending transversely from the first mounting plate 20. A second wall 34 extends from the first wall 32 to be spaced apart from and approximately parallel with the first mounting plate 20. In the embodiment shown, the second latch holder 28 includes a first wall 36 extending transversely from the second mounting plate 24. A second wall 38 extends from the first wall 36 to be spaced apart from and approximately parallel with the second mounting plate 24. The spacing between the second wall 34 of the first latch holder 28 and the second wall 38 of the second latch holder 30 with respect to the first mounting plate 20 and the second mounting plate 24, respectively, are dimensioned to receive a latch arm 40.

In the embodiment shown, the first mounting plate 20 and first latch holder 28 are symmetrical with the second mounting plate 24 and second latch holder 30 about an axis extending between and parallel to the first mounting plate 20 and second mounting plate 24. This symmetry allows the latch arm 40 to be reversibly mounted to either the first latch holder 28 or the second latch holder 30. In some embodiments, the first mounting plate 20/first latch holder 28 could be substantially identical to the second mounting plate 24/second latch holder 30 and could be mounted to either the left or side sides of the swingable member 16. This type of configuration not only makes installation easier by not requiring the user to know which parts are mounted to the post versus which are supposed to be mounted to the swingable member, but also reduces the number of parts needed for inventory purposes.

The latch arm 40 is reversibly mountable, which means it can be pivotally connected to either of the latch holders 28, 30 depending on whether a left-handed or a right-handed configuration is desired. In the example shown, the first latch holder 28 includes a pivot hole 42 (FIG. 2) axially aligned with a pivot hole 44 (FIG. 2) defined in the first mounting plate 20. Likewise, the second latch holder 30 includes a pivot hole 46 axially aligned with a pivot hole 48 defined in the second mounting plate 24. The latch arm 40 includes an opening 50 (FIG. 2) that is alignable with the pivot holes 42, 44 or 46, 48 in either the first latch holder 28/first mounting plate 20 or the second latch holder 30/second mounting plate 24 depending on the desired configuration. In the embodiment shown, the gap between the first mounting plate 20 and the second wall 34 of the first latch holder 28 are approximately the same as the gap between the second mounting plate 24 and the second wall 38 of the second latch holder 30.

In some embodiments, a spacer 52 may be provided with an opening 54 that is aligned with the opening 50 in the latch arm 40. For example, the spacer 52 may be a sleeve-like device that is received by an end of the latch arm 40 such that the openings 50, 54 are aligned when the spacer 52 is received on the latch arm 40. In the example shown, the spacer 52 includes an integral protrusion 55 on each side, which takes the place of one or more washers to simplify installation. As shown, the latch arm 40 and spacer 52 are symmetric about a generally horizontal axis, which allows the latch arm 40 to be reversed for a pivotal connection with either mounting plate 20, 24.

With the openings aligned, the latch arm 40 may be pivotally attached to either mounting plate 20, 24 using a pivot pin. In the embodiment shown, the pivot pin extends through both the latch holder 34 and mounting plate 20 to form a pivotal connection; however, embodiments are also contemplated in which the pivot pin may only extend through the mounting plate 20. In the example shown, the pivot pin comprises a first member 56 with an opening 57 that receives a second member 58 with a threaded connection. Although a two-piece pivot pin is shown for purposes of example, one skilled in the art should appreciate that other pivotal connections between the latch arm 40 and mounting plates 20, 24 could be used, whether with a single-piece pivot pin, multi-piece pivot pin or other arrangement. As shown, the latch arm 40 is pivotally connected with the first mounting plate 20 and therefore pivots about pivot pin 56, 58 in a clockwise direction from a latched position (as shown in FIG. 1) towards an unlatched position. However, the latch arm 40 could be pivotally connected to the second mounting plate 24 and therefore pivot in an opposite direction.

In the embodiment shown, the latch arm 40 includes a transversely extending locking flange 60 that defines an opening 62. The locking flange 60 is positioned on the locking arm 40 to be adjacent to a locking flange 64 with an opening 66 on the first latch holder 28 when the latch arm 40 is pivotally connected to the first mounting plate 20 or, if the latch arm 40 is installed on the second mounting plate 24, the locking flange 60 is adjacent a locking flange 68 with an opening 70 on the second latch holder 30. If the latch arm 40 is pivotally connected to the first mounting plate 20, such as shown in FIG. 1, the openings 62, 66 of the locking flanges 60, 64 are aligned when the latch arm 40 is in the closed position such that a user could insert a shackle of a padlock (not shown) therethrough to lock the latch assembly 10. Likewise, if the latch arm 40 is pivotally connected to the second mounting plate 24, the openings 62, 70 of the locking flanges 60,68 could be aligned such that a shackle of a padlock (not shown) could be inserted therethough to lock the latch assembly 10. In the embodiment shown, the opening 62 is longitudinally longer than openings 66, 70 to allow easier alignment. However, with the shackle of a padlock installed, the longer opening 62 in the locking flange 60 does not allow disengagement of the shackle with respect to the locking flange 60.

As shown, the latch arm 40 includes a handle 72 on an end opposite the end with the opening 50. The handle 72 provides a place for a user to grip the latch arm 40 when pivoting the latch arm 40 between an unlatched and latched position. Although the handle 72 is a transversely extending flange in the embodiment shown, one skilled in the art should appreciate that the handle 72 could come in many different forms depending on the desired aesthetics of the latch assembly 10. In the embodiment shown, the handle 72 extends beyond the second wall 34, 38 of the latch holders 28, 30 depending on whether the latch arm 40 is pivotally connected to the first latch holder 28 or the second latch holder 30. With the latch arm 40 connected to the first latch holder 28, as shown in FIG. 1, the handle 72 extends beyond the second latch holder 30. In some cases, the handle 72 could be optional and the user could grip the latch arm 40 in another position to move the latch arm 40 between the unlatched and latched positions.

Figure 3:
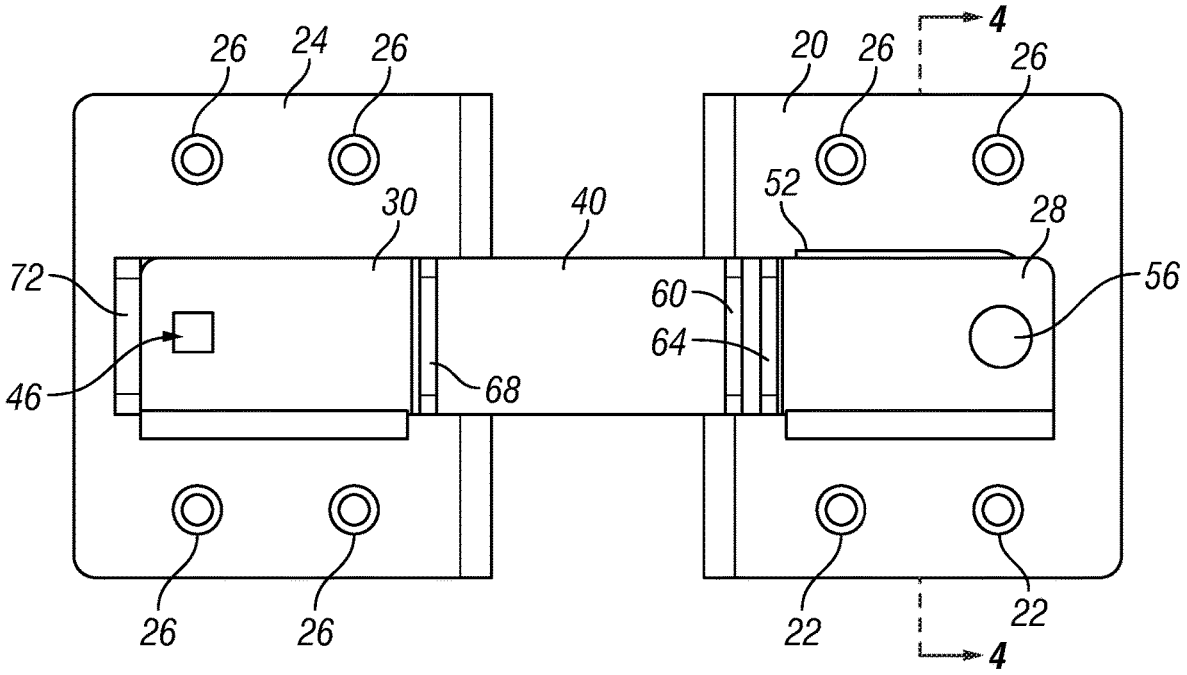
FIG. 3 is a front view of the example reversible latch assembly of FIG. 1.

FIG. 3 illustrates the latch arm 40 pivotally mounted via the pivot pin 56, 58 to the first mounting plate 20 and first latch holder 28. As shown, the latch arm 40 is in the closed or latched position. In this position, the latch handle 72 extends beyond the second latch holder 30 with a portion of the latch arm 40 received between the second wall 38 of second latch holder 30 and the second mounting plate 24. In the embodiment shown, the spacer 52 rests on the first wall 32 of the first latch holder 20, which suspends the other end of the latch arm 40 above the first wall 36 (FIG. 2) of the second latch holder 30. In this latched configuration, the opening 62 (FIG. 2) in locking flange 60 of the latch arm 40 and the opening 66 (FIG. 2) in locking flange 64 of first latch holder 28 are aligned providing a through-hole for a locking mechanism such as a padlock, combination lock, or other security device to pass through. The opening 70 (FIG. 2) in locking flange 68 of second latch holder 30 remains unused in this configuration. When the latch assembly 10 is unlocked, the opening 70 in the locking flange 68 of second latch holder 30 could be used to store the locking mechanism (or the opening 66 if the latch assembly 10 is reversed). This allows the locking mechanism to be kept with the latch assembly 10 while at the same time permitting the latching/unlatching function of the installed unit.

Figure 4:
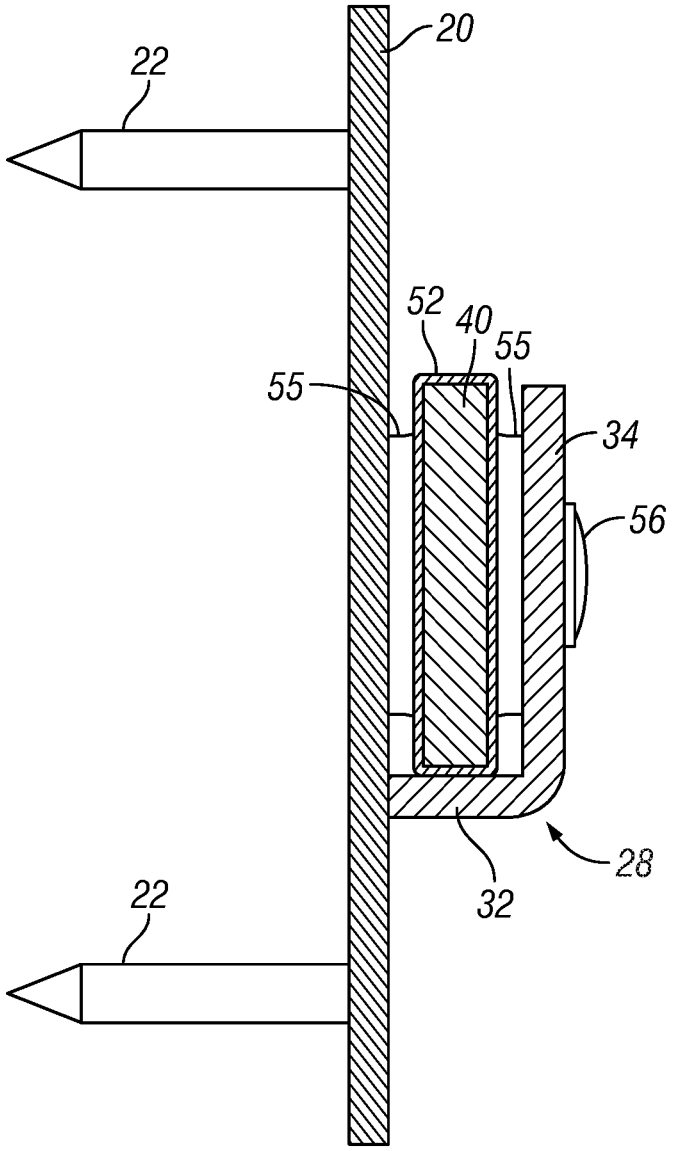
FIG. 4 is a cross-sectional view taken along the line 4-4 of FIG. 3.

FIG. 4 is a cross-sectional view of the latch assembly 10 taken along the line 4-4 of FIG. 3. As can be seen in this embodiment; the latch arm 40 is received within spacer 52 and rests on the first wall 32 of the first latch holder 28. The pivot pin 56, 58 extends through the aligned openings 42, 44, 50, 54 (See FIG. 2). In the embodiment shown, the spacer 52 includes symmetric protrusions 55 on opposite sides. The protrusions 55 may locate the reversible latch arm 32 equidistant between the first mounting plate 20 and second wall 34 of the first latch holder 28 to allow the latch arm 40 to more freely pivot with proper alignment. In embodiments in which the spacer 52 includes protrusions 55, this would eliminate the need for washers, which are commonly used as spacing elements in latches. The combination of the spacer 52 and protrusions 55, may be a unitary component, which permits ease of reversibility, or mounting to the second mounting plate 24 if a user decides to reverse the latching mechanism.

Figure 5:
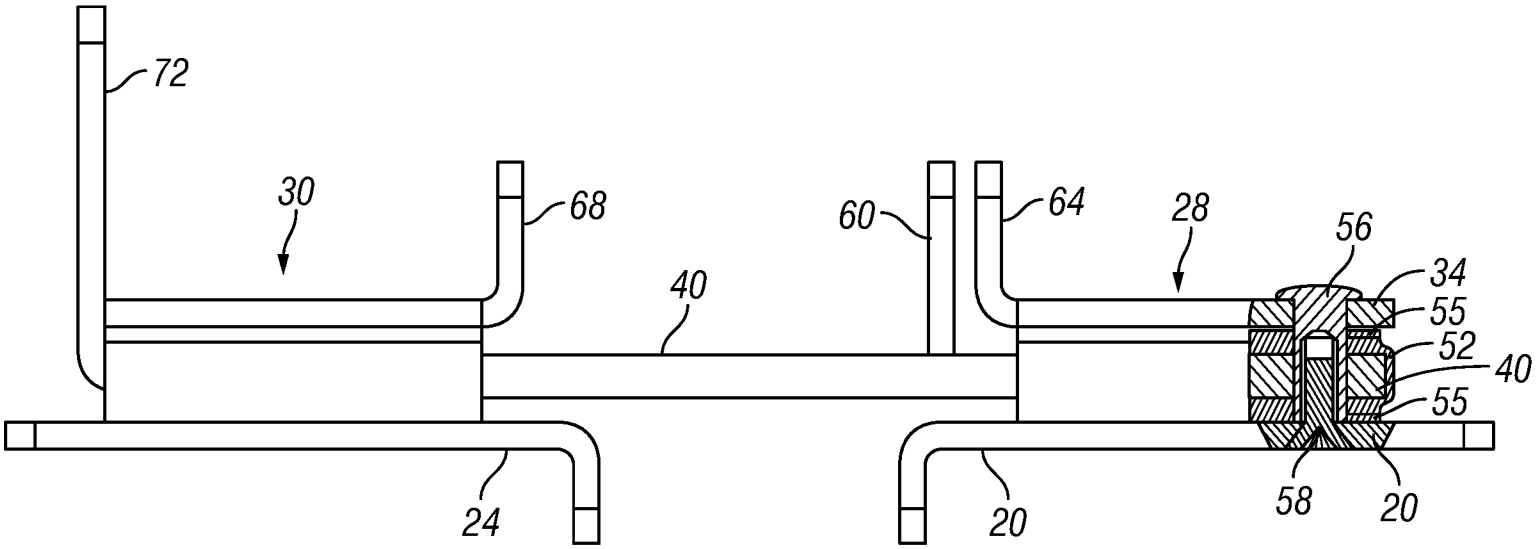
FIG. 5 is a partial cross-sectional view of the example reverse latch assembly of FIG. 1 as seen from a bottom view.

FIG. 5 shows a bottom partial cut-away view of the pivotal connection between the latch arm 40 and the first mounting plate 20 and first latch holder 28. In the embodiment shown, the first member 56 of pivot pin extends through the second wall 34 of the first latch holder 28, spacer 52 and latch arm 40. The second member 58 of pivot pin extends through the first mounting plate 20, spacer 52, latch arm 40 and is received with a threaded fit with the first member 56 of pivot pin. As previously described above, one skilled in the art should appreciate that other pivotal connections could be used to allow the latch arm 40 to pivot between open and closed positions.

During installation, the user can install the latch arm with a pivotal connection to either the first mounting plate 20 or the second mounting plate 24. Consider an example in which the user would like to pivotally connect the latch arm 40 to the first mounting plate 20. In this case, the user would place the spacer 52 over the latch arm 40 so the opening 50 is aligned with the opening 54. The user would position the latch arm 40 between the second wall 34 of the first latch holder 28 and the first mounting plate 20 so that openings 42, 44, 50, 54 are aligned. The first member 56 of pivot pin would be extended into opening 42 of the first latch holder 28 while the second member 58 of pivot pin would be extended into opening 44 of the first mounting plate 20 and screwed together. This forms a pivotal connection between the first mounting plate 20 and the latch arm 40. In the embodiment shown, the opening 42 has a non-circular shape that corresponds to the exterior shape of the first member 56 to prevent rotation of the first member 56 with respect to the opening 42. Although a generally square shape is shown for purposes of example, other non-circular shapes could be used. Upon making this pivotal connection, the mounting plates 20, 24 are fastened to the swingable member 16 and post 14. If the latch arm 40 is pivotally connected to the first mounting plate 20, the latch arm 40 will pivot in a clockwise connection from its latched position to its unlatched position. Conversely, if the latch arm 40 is pivotally connected to the second latch arm 30, the latch arm 40 will pivot in a counter-clockwise connection from its latched position to its unlatched position. If the user wants to reconfigure the latch assembly from a left-handed to a right-handed orientation (or visa-versa), the latch arm 40 could be reinstalled with the pivotal connection on the other mounting plate.

EXAMPLES

Illustrative examples of the latch assembly disclosed herein are provided below. An embodiment of the latch assembly may include any one or more, and any combination of, the examples described below.

Example 1 is a latch assembly with a first mounting plate and a second mounting plate. The assembly includes a first latch holder extending from the first mounting plate. A second latch holder is provided that extends from the second mounting plate. The assembly includes a latch arm including a first portion and a second portion. The latch arm is movable between an unlatched position and a latched position and is selectively reversible to be pivotally connected to either the first latch holder or the second latch holder.

In Example 2, the subject matter of Example 1 is further configured in which the latch arm is selectively reversibly such that: (1) the first portion is pivotally connected to the first latch holder while the second portion is proximate the second latch holder when the latch arm is in the latched position; and (2) the first portion is pivotally connected to the second latch holder while the second portion is proximate the first latch holder when the latch arm is in the latched position.

In Example 3, the subject matter of Example 1 is further configured in which the first latch holder includes a wall spaced apart from and approximately parallel with the first mounting plate and the latch arm is configured to be pivotally connected to the wall of the first latch holder and/or the first mounting plate.

In Example 4, the subject matter of Example 3 is further configured in which the second latch holder includes a wall spaced apart from and approximately parallel with the second mounting plate and the latch arm is configured to be pivotally connected to the wall of the second latch holder and/or the second mounting plate.

In Example 5, the subject matter of Example 4 is further configured in which the wall of the first latch holder defines an opening aligned with an opening in the first mounting plate and the wall of the second latch holder defines an opening aligned with an opening in the second mounting plate.

In Example 6, the subject matter of Example 5 is further configured with a pivot pin. When the latch arm is pivotally connectable to the first latch holder, the pivot pin extends through the opening in the first latch holder, an opening in the latch arm, and the opening in the first mounting plate.

In Example 7, the subject matter of Example 6 is further such that when the latch arm is pivotally connectable to the second latch holder, the pivot pin extends through the opening in the second latch holder, the opening in the latch arm, and the opening in the second mounting plate.

In Example 8, the subject matter of Example 7 is further configured with a pivot pin that includes a first member and a second member that are connected together.

In Example 9, the subject matter of Example 1 is further configured in which the first mounting plate and the first latch holder are symmetrical with the second mounting plate and the second latch holder about a generally vertical axis.

In Example 10, the subject matter of Example 1 is further configured in which the latch arm includes a locking flange extending approximately transversely from a longitudinal axis of the latch arm, wherein the locking flange defines an opening.

In Example 11, the subject matter of Example 10 is further configured in which the first latch holder includes a locking flange extending approximately transversely from the first mounting plate and the second latch holder includes a locking flange extending approximately transversely from the second mounting plate.

In Example 12, the subject matter of Example 11 is further configured such that when the latch arm is pivotally connected to the first latch holder, the locking flange of the latch arm is adjacent to the locking flange of the first latch holder and spaced apart from the locking flange of the second latch holder.

In Example 13, the subject matter of Example 12 is further configured such that when the latch arm is pivotally connected to the second latch holder, the locking flange of the latch arm is adjacent to the locking flange of the second latch holder and spaced apart from the locking flange of the first latch holder.

In Example 14, the subject matter of Example 1 is further configured with a sleeve-like spacer configured to receive at least a portion of the latch arm.

In Example 15, the subject matter of Example 14 is further configured such that the spacer defines an opening that is aligned with an opening in the latch arm when the latch arm is received in the spacer.

In Example 16, the subject matter of Example 15 is further configured such that the spacer includes an outwardly extending protrusion on at least one side.

Example 17 is a method of installing a latch assembly. The method includes providing a first mounting plate with a first latch holder extending therefrom, a second mounting plate with a second latch holder extending therefrom, and a latch arm movable between an unlatched position and a latched position. A determination is made whether the latch arm should be movable towards the latched position in a clockwise or counter-clockwise direction. The latch arm is pivotally connected to the first latch holder and/or the first mounting plate responsive to determining that the latch arm should move towards the latched position in a counter-clockwise direction. If a determination is made that the latch arm should move towards the latched position in a clockwise direction, the latch arm is pivotally connected to the second latch holder and/or the second mounting plate.

In Example 18, the subject matter of Example 17 is further configured by sliding a sleeve-like spacer onto an end of the latch arm prior to pivotally connect the latch arm to either: (1) the first latch holder and/or the first mounting plate; or (2) the second latch holder and/or the second mounting plate.

In Example 19, the subject matter of Example 17 is further configured such that when the latch arm pivot is pivotally connected to the first latch holder and/or the first mounting plate, a free end of the latch arm moves in and out between the second latch holder and the second mounting plate.

In Example 20, the subject matter of Example 19 is further configured such that the latch arm pivot is pivotally connected to the second latch holder and/or the second mounting plate, a free end of the latch arm moves in and out between the first latch holder and the first mounting plate.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

What is claimed is:

1. A latch assembly comprising:

a first mounting plate;

a second mounting plate, a first latch holder extending from the first mounting plate;

a second latch holder extending from the second mounting plate;

a latch arm being positionable within the first and second latch holders and movable between an unlatched position and a latched position, the latch arm being positioned within both the first and second latch holders when in the latched position, and the latch arm being positioned within only one of the first and second latch holders when in the unlatched position, wherein, when in the latched position, the latch arm reduces relative movement between the first and second latch holders, wherein, when in the unlatched position, the first and second latch holders are movable relative to one another; and wherein the latch arm is configured to be pivotally connected to either the first latch holder or the second latch holder to selectively reverse a handed configuration of the latch arm.

2. The latch assembly of claim 1, wherein the latch arm includes a first portion and a second portion, wherein the latch arm is configured such that: (1) the first portion is pivotally connected to the first latch holder while the second portion is proximate the second latch holder when the latch arm is in the latched position; or (2) the first portion is pivotally connected to the second latch holder while the second portion is proximate the first latch holder when the latch arm is in the latched position.

3. The latch assembly of claim 1, wherein the first latch holder includes a wall spaced apart from and approximately parallel with the first mounting plate and the latch arm is configured to be pivotally connected to the wall of the first latch holder and/or the first mounting plate.

4. The latch assembly of claim 3, wherein the second latch holder includes a wall spaced apart from and approximately parallel with the second mounting plate and the latch arm is configured to be pivotally connected to the wall of the second latch holder and/or the second mounting plate.

5. The latch assembly of claim 4, wherein the wall of the first latch holder defines an opening aligned with an opening in the first mounting plate and the wall of the second latch holder defines an opening aligned with an opening in the second mounting plate.

6. The latch assembly of claim 5, further comprising a pivot pin, wherein when the latch arm is pivotally connectable to the first latch holder, the pivot pin extends through the opening in the first latch holder, an opening in the latch arm, and the opening in the first mounting plate.

7. The latch assembly of claim 6, wherein when the latch arm is pivotally connectable to the second latch holder, the pivot pin extends through the opening in the second latch holder, the opening in the latch arm, and the opening in the second mounting plate.

8. The latch assembly of claim 7, wherein the pivot pin includes a first member and a second member that are connected together.

9. The latch assembly of claim 1, wherein the first mounting plate and the first latch holder are symmetrical with the second mounting plate and the second latch holder about a generally vertical axis.

10. The latch assembly of claim 1, wherein the latch arm includes a locking flange extending approximately transversely from a longitudinal axis of the latch arm, wherein the locking flange defines an opening.

11. The latch assembly of claim 10, wherein the first latch holder includes a locking flange extending approximately transversely from the first mounting plate and the second latch holder includes a locking flange extending approximately transversely from the second mounting plate.

12. The latch assembly of claim 11, wherein when the latch arm is pivotally connected to the first latch holder, the locking flange of the latch arm is adjacent to the locking flange of the first latch holder and spaced apart from the locking flange of the second latch holder.

13. The latch assembly of claim 12, wherein when the latch arm is pivotally connected to the second latch holder, the locking flange of the latch arm is adjacent to the locking flange of the second latch holder and spaced apart from the locking flange of the first latch holder.

14. The latch assembly of claim 1, further comprising a sleeve-like spacer configured to receive at least a portion of the latch arm.

15. The latch assembly of claim 14, wherein the spacer defines an opening that is aligned with an opening in the latch arm when the latch arm is received in the spacer.

16. The latch assembly of claim 15, wherein the spacer includes an outwardly extending protrusion on at least one side.

* * * * *